United States Patent [19]

Grob et al.

[11] Patent Number: 4,976,609

[45] Date of Patent: Dec. 11, 1990

[54] FLASHBACK RESISTANT INFRARED GAS BURNER APPARATUS

[75] Inventors: James T. Grob, Shreveport, La.; Richard N. Caron, Dorchester, Mass.

[73] Assignee: The Frymaster Corporation, Shreveport, La.

[21] Appl. No.: 281,448

[22] Filed: Dec. 8, 1988

[51] Int. Cl.[5] ..... F23D 3/40

[52] U.S. Cl. ..... 431/326; 431/328; 126/92 AC; 126/390; 126/343.5 R; 126/373; 99/403

[58] Field of Search ..... 126/92 R, 91 R, 92 AC, 126/369, 390, 391, 343.5 R, 343.5 A, 387, 366, 360 R, 376; 431/326, 327, 328, 329; 99/408, 403; 122/50, 140 A

[56] References Cited

U.S. PATENT DOCUMENTS

| | | | |
|---|---|---|---|
| 3,353,583 | 11/1967 | Silhavy et al. | 431/329 |
| 3,437,415 | 4/1969 | Davis et al. | 431/328 |
| 4,397,299 | 8/1983 | Taylor et al. | 126/391 |
| 4,848,318 | 7/1989 | Brewer | 431/328 |

FOREIGN PATENT DOCUMENTS

| | | | |
|---|---|---|---|
| 6859 | 3/1967 | Japan | 431/328 |

*Primary Examiner*—James C. Yeung

*Attorney, Agent, or Firm*—Hubbard, Thurman, Turner, Tucker & Harris

[57] ABSTRACT

A flashback inhibiting fuel fired infrared burner has a housing with a base wall, a side wall section extending outwardly from the base wall periphery, and a side opening positioned opposite the base wall. Retained in and covering the housing side opening is a foranimous burner plate structure. An air-fuel mixture supply pipe extends forwardly into the housing interior through a front end of the side wall section into a rear end portion of the housing interior and has an open outlet end. A discharge end portion of the supply pipe is received in an open front end portion of a flow reversing tube having a closed rear end. The supply pipe and flow reversing tube are laterally shrouded within the housing by an elongated baffle member having outlet openings formed in longitudinally extending front and rear wall portions thereof, the total cross-sectional area of the outlet openings in the front longitudinal wall portion being greater than that of the outlet openings in the rear longitudinal wall portion. The reversing tube and baffle member cooperate during burner startup to cause an air-fuel mixture discharged from the supply pipe to flow outwardly through front portion of the burner plate structure before a substantial portion of the air-fuel mixture is discharged from the balance of the plate structure, whereby a front mounted igniter may be utilized to start the burner without appreciable risk of creating a hard ignition condition or an associated flame flashback into the housing interior. To increase the radiant heat transfer capacity of the burner plate structure its exterior surface is coated with an emissivity enhancing material.

18 Claims, 3 Drawing Sheets

FLASHBACK RESISTANT INFRARED GAS BURNER APPARATUS

BACKGROUND OF THE INVENTION

The present invention relates generally to gas burner apparatus and, in a preferred embodiment thereof, more particularly provides uniquely configured flashback resistant infrared gas burner apparatus representatively incorporated in the frypot heating system of a deep fat cooking fryer.

Gas fired infrared burners are well known heating elements and are utilized in a variety of heating applications such as space heating in commercial and industrial establishments and as burners used to supply heat to commercial cooking equipment such as deep fat fryers. Burners of this general type typically comprise a rectangular metal housing having an open side within which one or more foranimous ceramic burner plates are suitably retained. Extending inwardly through a front end wall of the burner housing is a supply pipe which flows a suitable airgaseous fuel mixture into the housing interior. The pipe has an open inner end positioned within a rear end portion of the housing.

During startup of the burner, the air-fuel mixture discharged from the supply pipe begins to fill the burner housing, from the rear end of its housing toward the front end thereof, and is flowed outwardly through the perforations in the foranimous burner plate structure, the air-fuel mixture outflow beginning at the rearmost perforations and spreading to the frontmost perforations as the housing interior fills with the air-fuel mixture in a rear-to-front direction. When the forwardly spreading air-fuel mixture outflow reaches the front end of the outer side surface of the plate structure, an igniter positioned adjacent thereto ignites the air-fuel mixture to create and maintain a flame along essentially the entire exterior surface of the foranimous plate structure.

Particularly when the burner is incorporated in other heating equipment, such as the frypot section of a deep fat cooking fryer, it is necessary for access purposes to position the igniter adjacent the front or inlet end of the burner as just described. Coupled with the rearward pre-startup spread of the air-fuel mixture within the burner housing and across the exterior side surface of the foranimous plate structure, this necessary forward positioning of the igniter has heretofore created two interrelated burner startup problems—"hard" ignition and "flashback".

The hard ignition problem arises due to the often considerable volume of air-fuel mixture which is discharged from the plate structure before the discharged mixture spreads forwardly to the front-mounted igniter. Upon reaching the igniter the entire volume of discharged air-fuel mixture built up along the exterior side surface of the plate structure is rapidly ignited causing a minor (though potentially harmful) external explosion along the plate structure. The amount of burner damage this hard ignition can cause is increased in situations (such as in frypot heating applications) where the air-fuel mixture is discharged from the plate structure into and partially fills an enclosed heating passage prior to this "delayed" ignition.

Flashback occurs when the exterior burner flame travels inwardly through the burner plate perforations and undesirably ignites the air-fuel mixture within the burner housing, thereby causing an extremely rapid pressure rise therein which can cause considerable damage to the housing and its foranimous plate structure. To inhibit such flashback the perforations in the plate structure are normally sized to provide the air-fuel mixture with an outflow velocity through such perforations which is equal to or just slightly greater than the inward flame spread velocity of the burning mixture on the outer side of the plate structure. However, despite this precaution, a sufficiently "hard" ignition (particularly within a confined area such as a heating flow passage) can rapidly drive the resulting flame inwardly through the plate perforations and cause flashback.

The possibility of both hard ignition and flashback in conventional infrared burners of the conventional type just described is significantly enhanced when, as in the case of many underdeveloped countries, natural gas is unavailable as a fuel source and "manufactured" gas must be used to fire the burner. Because of the much greater flame spread velocity associated with, for example, naptha-based manufactured gas (compared to that of natural gas), both the hard ignition and associated flashback phenomenons tend to be considerably more forceful and therefore potentially more damaging to the overall burner structure.

In view of the foregoing it is a primary object of the present invention to provide an improved gas fired infrared burner in which the above-mentioned hard ignition and flashback problems are eliminated or at least very substantially reduced.

SUMMARY OF THE INVENTION

In carrying out principles of the present invention, in accordance with a preferred embodiment thereof, a flashback inhibiting fuel fired infrared burner is representatively incorporated as a frypot heating element in a deep fat cooking fryer. The burner comprises a housing having a base wall, a side wall section extending outwardly from the base wall periphery and having opposite front and rear end portions, and a side opening positioned opposite the base wall. A foranimous burner plate structure is retained in and covers the housing side opening.

Extending rearwardly into the housing interior through the front end portion of the housing is an air-fuel mixture supply pipe having an open outlet end positioned in a rear end of the housing interior. A discharge end portion of the supply pipe is coaxially received within an open front end portion of a flow reversing tube which has a closed rear end and defines with the supply pipe an annular, forwardly facing discharge passage from the interior of the flow reversing tube.

An elongated baffle member is laterally bent around the telescoped supply pipe and flow reversing tube and is secured at opposite side edge poritons thereof to the housing base wall. The baffle member defines around the supply pipe and flow reversing tube a transfer passage which extends rearwardly from the front end of the housing, the baffle member having front and rear longitudinal portions with outlet openings formed therethrough. The total cross sectional area of the outlet openings in the front longitudinal portion of the baffle member is greater than the total cross sectional area of the outlet openings in its rear longitudinal portion.

During burner startup, an air fuel mixture is discharged from the supply pipe rearwardly into the flow reversing tube. The flow reversing tube causes the initially discharged air-fuel mixture to reverse direction and to flow forwardly through the discharge passage between the flow reversing tube and the supply pipe into a front end portion of the transfer passage. The air-fuel mixture entering the front end of the transfer passage is flowed outwardly through the front baffle wall outlet openings prior to a substantial portion of the air-fuel mixture being discharged from the transfer passage through its rear wall openings.

In this manner the initially rearwardly discharged air-fuel mixture is caused to flow outwardly through a front portion of the burner plate perforations prior to a substantial air-fuel mixture outflow through the rear burner plate perforations. Because of this unique feature of the present invention, a front mounted igniter, positioned adjacent a front portion of the exterior side surface of the burner plate structure, may be used to start the burner without a substantial risk of a "hard" ignition condition or an associated flame flashback into the burner housing interior through the burner plate structure.

The radiant heat transfer capacity of the burner is enhanced by spraying a suitable emissivity coating onto the outer surface of the foranimous burner structure in the assembled burner. To prevent the coating from clogging the burner plate perforations, air is forced into the burner housing and outwardly through such perforations during the spraying process.

DETAILED DESCRIPTION

Figure 1:
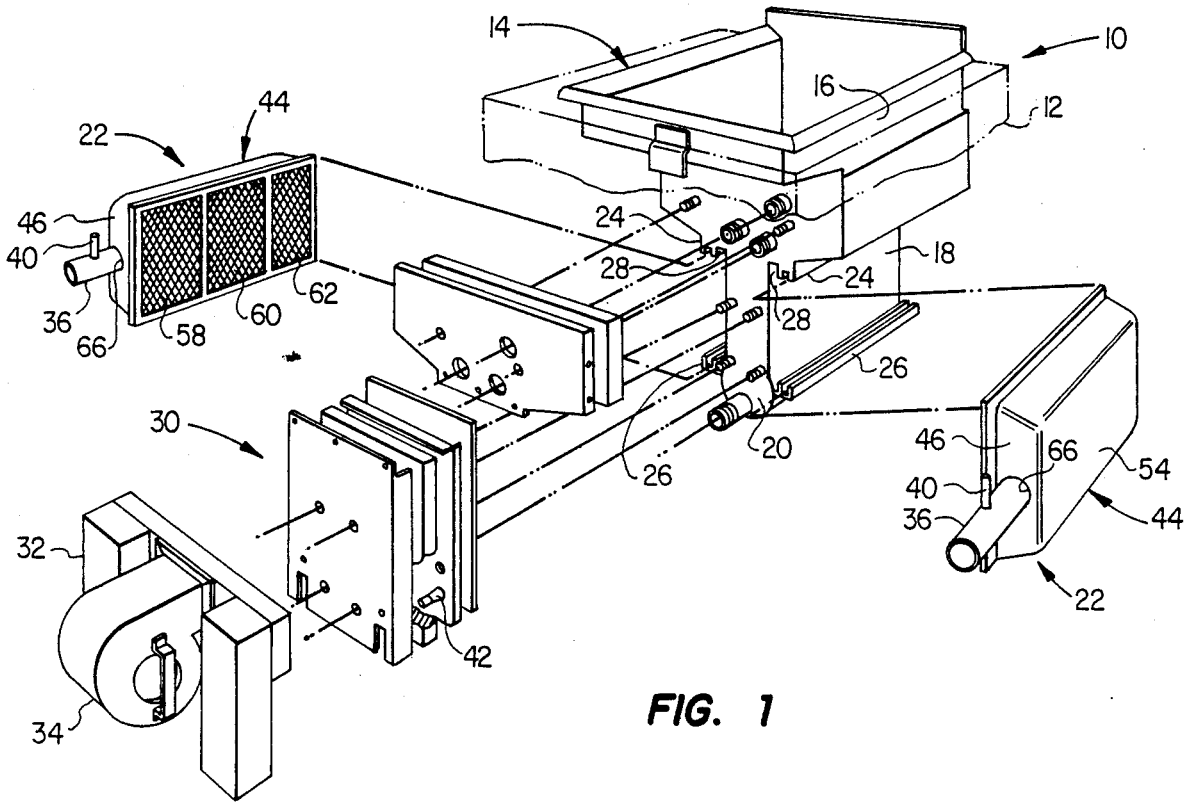
FIG. 1 is a simplified, partially exploded perspective view of an upper portion of a deep fat cooking fryer whose frypot is provided with a pair of flashback resistant infrared gas burners incorporating principles of the present invention.
Figure 2:
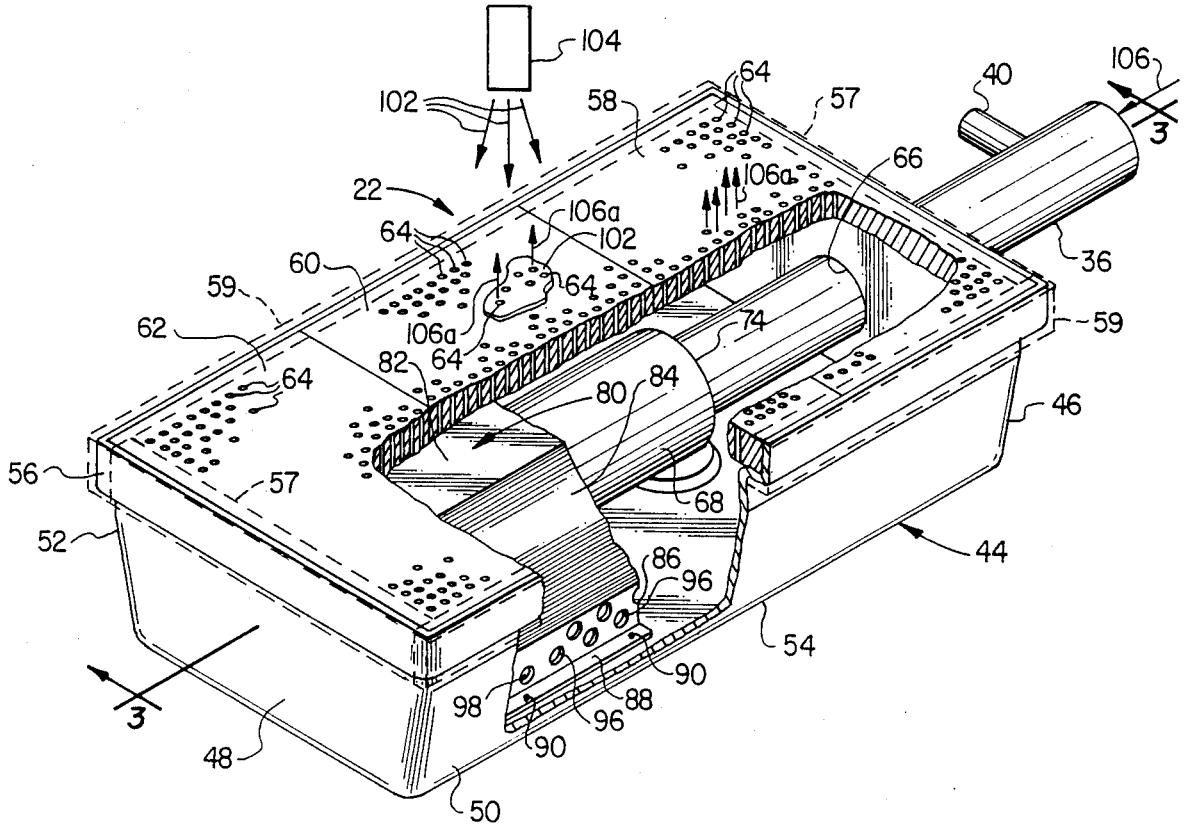
FIG. 2 is an enlarged scale, partially cut away perspective view of one of the burners.

In accordance with a preferred embodiment thereof, the present invention provides a commercial deep fat frying cooker 10 which is partially illustrated in FIG. 1 and comprises a floor mounted housing 12 within an upper portion of which a metal frypot 14 is operatively supported. The frypot is adapted to hold a quantity of heated cooking fluid, such as melted lard or liquid cooking oil, into which the food items to be deep fat fried are immersed. Frypot 14 is of a conventional configuration and construction, and is provided with an upper cooking zone 16, a narrowed, vertically intermediate heating zone 18, and a "cold" well 20 having relatively cooler cooking oil therein into which breading bits and other food particles fall and are retained without burning.

Mounted on the frypot 14 on opposite sides of the heating section 18 are a pair of uniquely constructed gas fired infrared burners 22 which incorporate principles of the present invention and are used to heat the frypot section 18, and thus the cooking fluid disposed within the frypot. The burners 22 are supported in a conventional manner between elongated upper and lower mounting structures 24 and 26 formed on the frypot sections 16 and 20 as illustrated in FIG. 1. The burners are spaced outwardly from opposite side surfaces of the frypot heating section 18 and define therewith heating passages 28 through which products of combustion emanating from the burners 22 are flowed.

Operatively secured to the front end of the frypot 14 to fire the burners 22 is a conventional firing structure 30 which includes an air supply manifold 32 into which supply air is flowed by a motor-driven fan 34. Connected to the outlet side of the manifold 32 are a pair of supply pipes 36 having open outlet ends 38 (see FIGS. 3 and 4). A fuel gas inlet pipe 40 is connected to each of the supply pipes 36. During operation of the cooker 10, air discharged from the manifold 32 into the supply pipes 36 is mixed therein with gaseous fuel supplied through the fuel pipes 40 and discharged into the burners 22 in a manner subsequently described. The air-fuel mixture received within the burners 32 is discharged therefrom into the frypot heating passages 28 and ignited by a front mounted igniter portion 42 of the firing structure 30.

Figure 3:
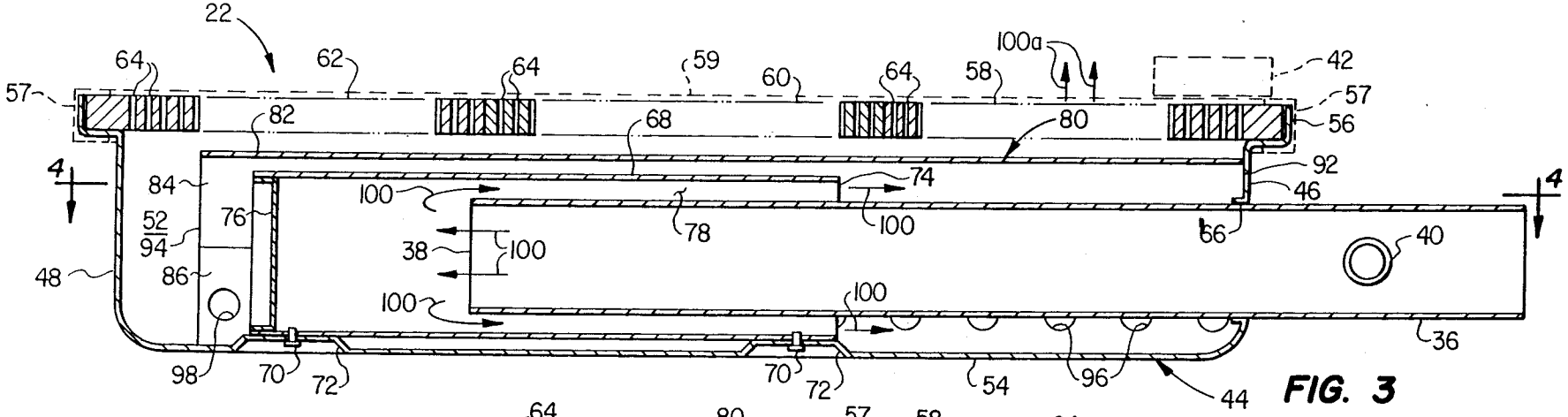
FIG. 3 is a cross-sectional view through the burner taken along line 3—3 of FIG. 2.
Figure 4:
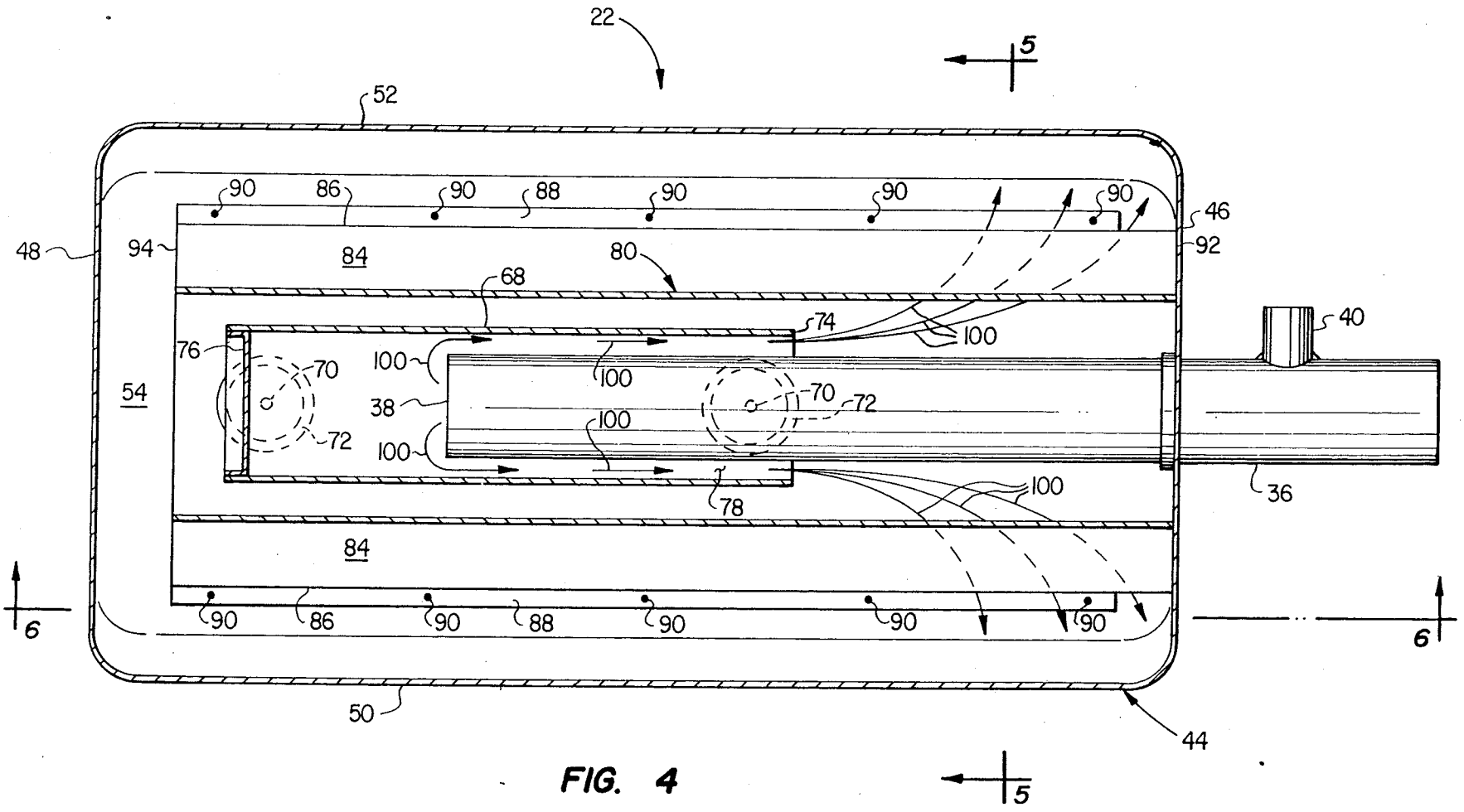
FIG. 4 is a cross-sectional view through the burner taken along line 4—4 of FIG. 3.

Referring now to FIGS. 2–6, each of the infrared burners 22 includes an elongated, generally rectangular metal housing 44 having a front end wall 46, a rear end wall 48, a pair of opposite side walls 50 and 52, a base wall 54, and an open top side which is bordered by a peripheral, outwardly offset retaining lip portion 56. Received within the lip portion 56, and retained therein over the top side opening of the housing by elongated end and side clip members 57 and 59 (illustrated in phantom) which have generally U-shaped cross-sections and snap over the lip 56, are three foranimous ceramic burner plates 58, 60 and 62, each having a multiplicity of mutually spaced perforations 64 extending transversely therethrough between its opposite exterior and interior side surfaces. Burner plate 58 is positioned at the front end of the housing 44, burner plate 62 is positioned at the rear end of the housing, and burner plate 60 is positioned between the other two plates. The air-fuel mixture supply pipe 36 extends rearwardly into the housing interior through an internally flanged opening 66 formed in the front end wall 46 of the housing 44, the pipe being suitably secured to the front end wall 46, as by welding. As best illustrated in FIGS. 3 and 4, the open outlet end 38 of the supply pipe 36 is positioned rearwardly of the front housing wall 46 a distance approximately two thirds that of the distance between the housing end walls 46 and 48.

Positioned within the interior of the housing 44 is a flow reversing tube 68 which is secured to the housing base wall 54 by rivets 70 which intersecure side wall portions of the tube 68 and raised portions 72 of the base wall 54. Flow reversing tube 68 is of a larger diameter than the supply pipe 36, is coaxial therewith, and has an open front end 74 and a closed rear end 76 which is spaced forwardly of and faces the rear housing end wall 48. As best illustrated in FIGS. 3 and 4, an outlet end portion of the supply tube 36 is coaxially received within a front portion of the flow reversing tube 68 and defines therewith an annular discharge passage 78 which opens outwardly through the open front end 74 of the tube 68, such open end 74 being positioned rearwardly of the front housing end wall 46.

Figure 5:
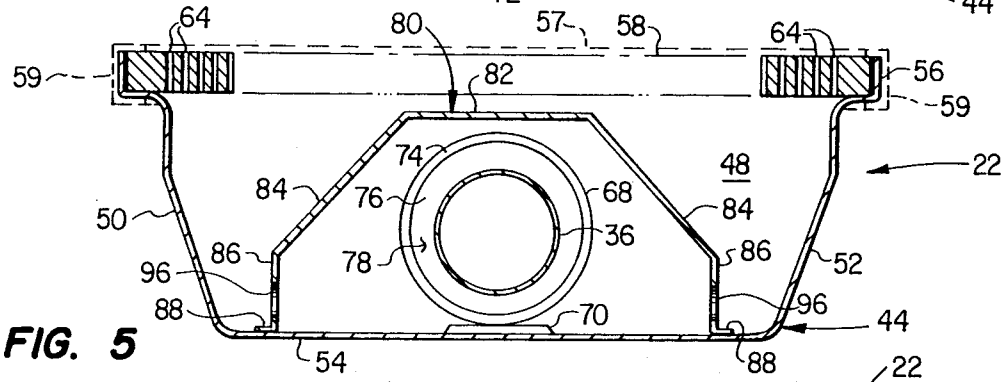
FIG. 5 is a cross-sectional view through the burner taken along line 5—5 of FIG. 4.
Figure 6:
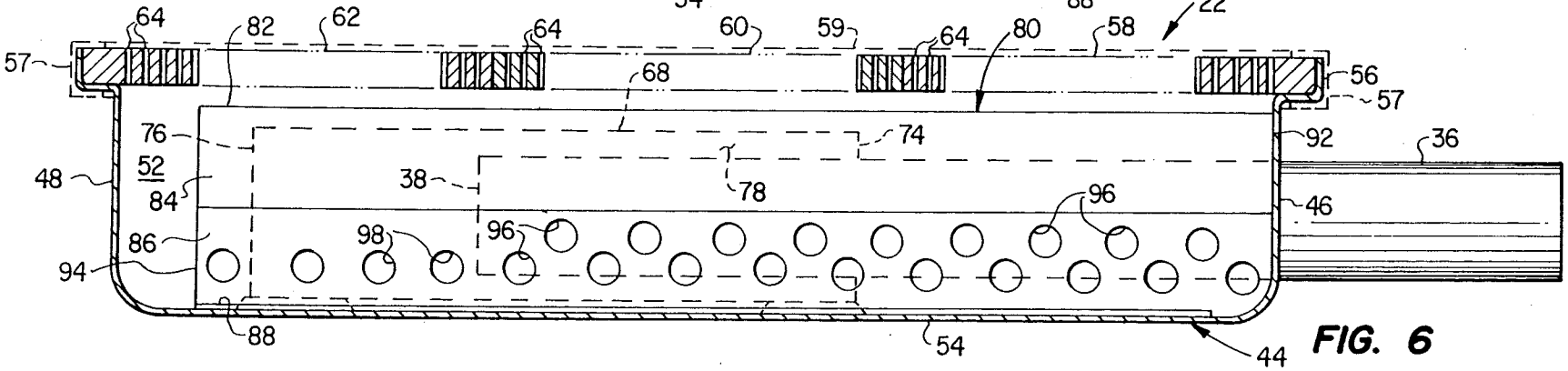
FIG. 6 is a cross-sectional view through the burner taken along line 6—6 of FIG. 4.

An elongated baffle member 80 is positioned within the interior of the housing 44 and, as viewed in FIG. 5, has a generally inverted U-shaped cross-section along its length. The baffle member 80 is laterally bent around the telescoped supply pipe 36 and flow reversing tube 68 and has a top wall 82, and a pair of opposite, downwardly and outwardly sloped side wall portions 84 which terminate at their outer ends in a pair of vertically disposed side wall sections 86 having external flanges 88 thereon secured to the housing base wall 54 by a spaced series of spot welds 90 (FIG. 4). The front end 92 of the baffle member 80 is secured to the housing front end wall 46, and the rear end 94 of the baffle member is open, and is positioned between the rear housing end wall 48 and the closed end 76 of the flow reversing tube 68.

For purposes later described, the baffle member 80 forms around the supply tube and flow reversing tube within the housing interior a transfer passage 95. The baffle member vertical side wall portions 86 have front longitudinal portions which extend generally between the outlet end 38 of the supply tube 36 and the front end wall 46 of the housing, and rear longitudinal portions which extend generally between the outlet end 38 of the supply pipe and the rear end 94 of the baffle member. Two staggered rows of circular outlet openings 96 are formed in these front longitudinal side wall portions of the baffle member, while single rows of similarly sized circular outlet openings 98 are formed in the rear longitudinal portions of these baffle member side wall portions 86. It can readily be seen that the total cross sectional area of the outlet openings 96 is considerably greater than the total cross sectional area of the outlet openings 98.

During startup of the burner 22, the air-fuel mixture 100 initially discharged from the outlet end 38 of the supply pipe 36 (FIGS. 3 and 4) is flowed into the closed rear end portion of the flow reversing tube 68. This initial mixture flow is then caused to reverse direction and flow forwardly through the annular discharge passage 78 into a front end portion of the transfer passage 95, thereby beginning to fill the transfer passage in a front-to-rear direction (i.e., a right-to-left direction as viewed in FIGS. 3 and 4). As the transfer passage 95 begins to fill in this manner, the air-fuel mixture therein is discharged outwardly through the frontmost baffle member wall openings 96, with the air-fuel mixture outflow through the baffle member wall openings subsequently spreading rearwardly to the remainder of the outlet openings 96 and the outlet openings 98.

Because of this rearwardly progressing outflow of air-fuel mixture through the baffle wall openings 96 and 98, a similar rearwardly progressing outflow through the burner plate structure perforations 64 is achieved—despite the fact that the air-fuel mixture is initially discharged in a rearward direction into a rear end portion of the housing interior. Thus, the first portion $100_a$ of the air-fuel mixture 100 to be outwardly discharged from the burner plate structure for ignition by the front-mounted igniter 42 is positioned along the front burner plate 58. As the transfer passage 96 continues to fill, the airfuel mixture outflow through the burner plate structure progressively spreads rearwardly along its length.

Importantly, because the initial air-fuel mixture outflow through the perforated burner plate structure occurs closely adjacent the igniter 42, the amount of air-fuel mixture that the igniter initially lights is relatively small, the resulting flame spreading rearwardly along the outer side surface of the burner plate structure in a smooth manner as the air-fuel mixture outflow spreads rearly along such outer side surface. Because the igniter 42 initially operates on only a relatively small volume of air-fuel mixture (as opposed to the conventional situation in which the mixture outflow must spread forwardly across the burner plate structure until it reaches the front mounted igniter), the conventional problem of "hard" ignition is essentially eliminated. Additionally, since the initial ignition of the air-fuel mixture discharged outwardly through the burner plate structure is substantially "softened" by the previously described mixture flow control means disposed within the housing interior (i.e., the flow reversing tube 68 and the baffle member 80), the associated problem of flame flashback into the housing interior is also essentially eliminated.

The mixture flow control means just described are easily and quite inexpensively fabricated and installed within the burner housing, and provide a very simple, yet highly effective solution to both the hard ignition and flame flashback problems typically encountered in conventional gas fired infrared burners.

Referring again to FIG. 2, to improve the radiant heat transfer capacity of the assembled burners 22, the exterior surfaces of their burner plates 58, 60 and 62 are spray-coated with an emissivity coating 102 utilizing suitable spray apparatus 104. The coating 102, representative of a variety of emissivity coatings which could be utilized, is manufactured by A. F. Holden Co., Milford, MI, under the name "Heat Unity Coating", and is conventionally used to coat oven refractory linings to increase radiant heat transfer rates thereof. To prevent the coating 102, during spray application thereof, from clogging the burner plate perforations 64, air 106 is forced into the housing 44 via supply tube 36 during the spraying process. This creates air streams $106_a$ which are discharged through perforations 64 to keep them from being clogged with coating 102.

The foregoing detailed description is to be clearly understood as being given by way of illustration and example only, the spirit and scope of the present invention being limited solely by the appended claims.

What is claimed is:

1. An improved fuel fired infrared burner comprising:

a housing having spaced apart front and rear wall portions and a wall opening extending between said front and rear wall portions, said front wall portion having an opening therein for receiving an air-fuel mixture supply pipe inserted forwardly therethrough to position an open outlet end of the pipe within a rear portion of the housing interior so that an air-fuel mixture discharged from the pipe is directed toward said rear end wall portion of said housing;

a burner plate structure retained in and covering said wall opening, said burner plate structure having opposite exterior and interior side surfaces between which a spaced series of relatively small cross-section perforations extend for discharging from the housing an air-fuel mixture to be burned along said exterior side surface of said burner plate structure; and mixture flow control means positioned within said housing and operative during burner startup for causing an air-fuel mixture being flowed into a rear interior portion of said housing to be initially discharged from said burner plate structure through a front portion of said perforations therein prior to a substantial air-fuel mixture outflow through the balance of said perforations, whereby an igniter positioned adjacent a front outer side surface portion of said burner plate structure may be used to ignite the initial air-fuel mixture outflow from said burner plate structure without a substantial risk of a hard ignition condition or an associated flame flashback into the housing interior through said burner plate structure.

2. The burner of claim 1 further comprising:

an air-fuel mixture supply pipe secured to said housing and extending rearwardly through said front end wall portion opening into the interior of said housing, said air-fuel mixture supply pipe having an open outlet end positioned in a rear interior portion of said housing.

3. The burner of claim 1 wherein:

said mixture flow control means include flow reversing means for causing an air-fuel mixture rearwardly discharged from the pipe to reverse direction and flow toward said housing front wall portion prior to flowing outwardly through said burner plate structure.

4. The burner of claim 3 wherein:

said mixture flow control means further include baffle means extending outwardly around said flow reversing means for receiving the reversed air-fuel mixture flow and outwardly discharging it from within said baffle means into a front interior portion of said housing prior to discharging a substantial portion of the reversed air-fuel mixture flow into the balance of the housing interior.

5. The burner of claim 4 wherein:

said baffle means comprise an elongated baffle member defining an elongated transfer passage longitudinally extending rearwardly from said front housing wall portion into a rear interior portion of said housing, said baffle member having wall openings formed in front and rear portions thereof, the total cross-sectional area of the wall openings in said front baffle member portion being greater than the total cross-sectional area of the wall openings in said rear baffle member portion.

6. The burner of claim 1 wherein:

said mixture flow control means include an elongated baffle member defining within the housing interior a transfer passage extending rearwardly from said front wall portion of said housing and positioned to receive an air-fuel mixture discharged from the pipe, said baffle member having front and rear longitudinal portions with outlet openings formed therethrough, the total cross-sectional area of the outlet openings in said front longitudinal portion being greater than the total cross-sectional are of the outlet openings in said rear longitudinal portion.

7. The burner of claim 1 wherein:

said exterior side surface of said burner plate structure is coated with an emissivity enhancing material adapted to increase the radiant heat transfer capacity of said burner plate structure.

8. An improved fuel fired infrared burner comprising:

a housing having spaced apart front and rear wall portions and a wall opening extending between said front and rear wall portions, said front wall portion having an opening therein for receiving an air-fuel mixture supply pipe inserted forwardly therethrough to position an open outlet end of the pipe within a rear portion of the housing interior so that an air-fuel mixture discharged from the pipe is directed toward said rear end wall portion of said housing;

a burner plate structure retained in and covering said wall opening, said burner plate structure having opposite exterior and interior side surfaces between which a spaced series of relatively small cross-section perforations extend for discharging from the housing an air-fuel mixture to be burned along said exterior side surface of said burner plate structure; and mixture flow control means positioned within said housing and operative during burner startup for causing an air-fuel mixture being flowed into a rear interior portion of said housing to be initially discharged from said burner plate structure through a front portion of said perforations therein prior to a substantial air-fuel mixture outflow through the balance of said perforations, whereby an igniter positioned adjacent a front outer side surface portion of said burner plate structure may be used to ignite the initial air-fuel mixture outflow from said burner plate structure without a substantial risk of a hard ignition condition or an associated flame flashback into the housing interior through said burner plate structure, said mixture flow control means including flow reversing means for causing an air-fuel mixture rearwardly discharged from the pipe to reverse direction and flow toward said housing front wall portion prior to flowing outwardly through said burner plate structure, said flow reversing means including a flow reversing tube positioned within said housing and having a closed end facing said rear housing wall portion and an open end facing and spaced apart from said front housing wall portion, a front longitudinal portion of said flow reversing tube being positioned and configured to receive a discharge end portion of the pipe and form therewith a discharge passage from said flow reversing tube.

9. A deep fat fryer comprising a fryer housing; a frypot supported in an upper portion of said fryer housing and adapted to hold a quantity of cooking fluid, said frypot having front and rear ends and a side wall section, extending between said front and rear ends, to which heat may be transferred to heat the cooking fluid; and a heating system for supplying heat to said wall section of said frypot, said heating system including:

at least one fuel fired infrared burner having:

a burner housing having spaced apart front and rear wall portions, and a side wall opening which faces and is spaced apart from said side wall section of said frypot, an air fuel mixture supply pipe for flowing an air-fuel mixture from a source thereof into the interior of said burner housing, said air-fuel mixture supply pipe extending rearwardly through said front wall portion of said burner housing and having an open outlet end positioned in a rear portion of burner housing interior, a burner plate structure retained in and covering said side wall opening of said burner housing, said burner plate structure having opposite exterior and interior side surfaces between which a spaced series of relatively small cross-section perforations extend for discharging from the burner housing an airfuel mixture to be burned along said exterior side surface of said burner plate structure, and mixture flow control means positioned within said burner housing and operative during burner startup for causing an air-fuel mixture being flowed into a rear interior portion of said burner housing to be initially discharged from said burner plate structure through a front portion of said perforations therein prior to a substantial air-fuel mixture outflow through the balance of said perforations;

means for flowing an air-fuel mixture inwardly through said air-fuel mixture supply pipe; and front mounted igniter means, positioned adjacent a front portion of said exterior side surface of said burner plate structure, for igniting an air-fuel mixture outwardly discharged through said burner plate structure, whereby said igniter means may be utilized to ignite the initial air-fuel mixture outflow from said burner plate structure without an appreciable risk of a hard ignition condition or an associated flame flashback into the burner housing interior through said burner plate structure.

10. The deep fat fryer of claim 9 wherein:

said mixture flow control means include flow reversing means for causing an air-fuel mixture rearwardly discharged from said air-fuel mixture supply pipe to reverse direction and flow toward said front wall portion of said burner housing prior to flowing outwardly through said burner plate structure.

11. The deep fat fryer of claim 9 wherein:

said mixture flow control means further include baffle means extending outwardly around said flow reversing means for receiving the reversed air-fuel mixture flow and discharging it into a front interior portion of said burner housing prior to discharging a substantial portion of the reversed air-fuel mixture flow into the balance of the burner housing interior.

12. The deep fat fryer of claim 11 wherein:

said baffle means comprise an elongated baffle member defining an elongated transfer passage longitudinally extending rearwardly from said front wall portion of said burner housing into a rear interior portion of said burner housing, said baffle member having wall openings formed in front and rear portion thereof, the total cross-sectional area of the wall openings in said front baffle member portion being greater than the total cross-sectional area of the wall openings in said rear baffle member portion.

13. The deep fat fryer of claim 9 wherein:

said exterior side surface of said burner plate structure is coated with an emissivity enhancing material adapted to increase the radiant heat transfer capacity of said burner plate structure.

14. A deep fat fryer comprising a fryer housing; a frypot supported in an upper portion of said fryer housing and adapted to hold a quantity of cooking fluid, said frypot having front and rear ends and a side wall section, extending between said front and rear ends, to which heat may be transferred to heat the cooking fluid; and a heating system for supplying heat to said wall section of said frypot, said heating system including:

at least one fuel fired infrared burner having:

a burner housing having spaced apart front and rear wall portions, and a side wall opening which faces and is spaced apart from said side wall section of said frypot, an air fuel mixture supply pipe for flowing an air-fuel mixture from a source thereof into the interior of said burner housing, said air-fuel mixture supply pipe extending rearwardly through said front wall portion of said burner housing and having an open outlet end positioned in a rear portion of the burner housing interior, a burner plate structure retained in and covering said side wall opening of said burner housing, said burner plate structure having opposite exterior and interior side surfaces between which a spaced series of relatively small cross-section perforations extend for discharging from the burner housing an air-fuel mixture to be burned along said exterior side surface of said burner plate structure, and mixture flow control means positioned within said burner housing and operative during burner startup for causing an air-fuel mixture being flowed into a rear interior portion of said burner housing to be initially discharged from said burner plate structure through a front portion of said perforations therein prior to a substantial air-fuel mixture outflow through the balance of said perforations;

means for flowing an air-fuel mixture inwardly through said air-fuel mixture supply pipe; and front mounted igniter means, positioned adjacent a front portion of said exterior side surface of said burner plate structure, for igniting an air-fuel mixture outwardly discharged through said burner plate structure, whereby said igniter means may be utilized to ignite the initial air-fuel mixture outflow from said burner plate structure without an appreciable risk of a hard ignition condition or an associated flame flashback into the burner housing interior through said burner plate structure, said mixture flow control means including flow reversing means for causing an air-fuel mixture rearwardly discharged from said air-fuel mixture supply pipe to reverse direction and flow toward said front wall portion of said burner housing prior to flowing outwardly through said burner plate structure, said flow reversing means including a flow reversing tube positioned within said burner housing and having a closed end facing said rear wall portion of said burner housing and an open end facing and spaced apart from said front wall portion of said burner housing, a front longitudinal portion of said flow reversing tube coaxially receiving a discharge end portion of said air-fuel mixture supply pipe and forming therewith a discharge passage from said flow reversing tube.

15. A flashback inhibiting fuel fired infrared burner comprising:

a housing having an elongated rectangular base wall, a side wall section extending outwardly from the periphery of said base wall and having opposite front and rear end portions, and a side opening positioned opposite said base wall and extending between said opposite front and rear end portions of said side wall section;

a foranimous burner plate structure retained in and covering said side opening;

an air-fuel mixture supply pipe extending rearwardly through said front end portion of said side wall section having an open discharge end positioned in a rear portion of the housing interior; and a tube member supported within the housing interior and having a closed end facing said rear end portion of said side wall section and an open end facing and spaced apart from said front end portion of said side wall section, a front longitudinal portion of said tube member receiving a discharge end portion of said air-fuel mixture supply pipe and forming therewith a discharge passage from the interior of said tube member.

16. The burner of claim 15 further comprising:

an elongated baffle member supported within the housing interior and bent laterally over said air-fuel mixture supply pipe and said tube member to form therewith an air-fuel mixture transfer passage which extends rearwardly from said front end portion of said side wall section, said baffle member having longitudinally extending front and rear wall portions with outlet openings formed therethrough, the total cross-sectional area of the outlet openings in said front wall portion of said baffle member being greater than the total cross-sectional area of the outlet openings in said rear wall portion of said baffle member.

17. The burner of claim 15 wherein:

said foranimous burner plate structure has an exterior surface coated with an emmisivity enhancing material adapted to increase the radiant heat transfer capacity of said burner plate structure.

18. The burner of claim 15 wherein:

said side opening of said housing is bordered by a peripheral retaining lip portion of said housing, and said burner plater structure has a peripheral edge portion retained in said lip portion by a plurality of retaining clip members having generally U-shaped cross-sections and receiving portions of said retaining lip portion.

* * * * *